US006551983B1

(12) United States Patent
Welch et al.

(10) Patent No.: US 6,551,983 B1
(45) Date of Patent: Apr. 22, 2003

(54) BLEACH-CONTAINING DETERGENT COMPOSITION

(75) Inventors: Robert Gary Welch, Mason, OH (US); Alison Lesley Main, Whitley Bay (GB); Richard Timothy Hartshorn, Northumberland (GB); Tiffany Alice Hensman, Jesmond (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/831,003

(22) PCT Filed: Nov. 5, 1999

(86) PCT No.: PCT/US99/26137

§ 371 (c)(1),
(2), (4) Date: Jul. 23, 2001

(87) PCT Pub. No.: WO00/27968

PCT Pub. Date: May 18, 2000

(30) Foreign Application Priority Data

Nov. 7, 1998 (GB) ..... 9824358

(51) Int. Cl.[7] ..... C11D 3/395; C11D 17/00

(52) U.S. Cl. ..... 510/446; 510/375

(58) Field of Search ..... 510/375, 446

(56) References Cited

FOREIGN PATENT DOCUMENTS

| | | |
|---|---|---|
| EP | 0 657 528 A1 | 6/1995 |
| WO | WO 90/14412 | 11/1990 |
| WO | WO 95/16019 | 6/1995 |
| WO | WO 97/35951 | 10/1997 |

*Primary Examiner*—Yogendra N. Gupta
*Assistant Examiner*—John M Petruncio
(74) *Attorney, Agent, or Firm*—Kevin L. Waugh; Marianne Dressman

(57) ABSTRACT

The invention relates to a detergent composition comprising a bleach-sensitive component and a hydrogen peroxide source, wherein the hydrogen peroxide source is present in a particulate component having an average particle size, by weight, of from 700 microns to 1100 microns, preferably from 750 microns to 1000 microns, whereby at least 80% by weight of the particulate component comprising the hydrogen peroxide source has a particle size of between 70% to 130% of the average particle size. The compositions preferably comprise a bleach activator of a specified average particle size.

10 Claims, No Drawings

BLEACH-CONTAINING DETERGENT COMPOSITION

FIELD OF THE INVENTION

The invention relates to detergent compositions comprising bleach sensitive ingredients and a hydrogen peroxide source of a specific particle size.

BACKGROUND OF THE INVENTION

Bleach-containing detergent compositions generally contain an oxygen-based bleach, typically a perborate or percarbonate salts which releases hydrogen peroxide in the wash water, and often a bleach activator or precursor. In solid detergent compositions, these compounds are typically admixed as separate granules to the base composition.

Detergents also contain certain ingredients which are bleach-sensitive and which can react with the bleaching agent during manufacturing or storage or in use. Thus, these bleach-sensitive ingredients may loose some of their performance when present in bleach-containing compositions. For example perfumes, enzymes, dyes and brighteners can react with bleaching agent, in particular, percarbonate and perborate bleach and in particular when they are present as spray-on component or as admixed component. Various techniques are known to protect the bleach-sensitive ingredients, for example coating of these ingredients. However, there is still a need to further improve the stability of bleach-sensitive ingredients.

The inventors have now found that this problem can be reduced when particulate hydrogen peroxide sources of a specific, larger particle size and having a narrow particle size distribution are incorporated in the solid detergent compositions. It is believed that this is due to the fact that the larger particle size hydrogen peroxide sources have a smaller surface area per weight unit and thus per active oxygen or available oxygen.

There is thus a smaller total surface area per amount of active oxygen bleach in the composition, which may be in contact with the bleach-sensitive ingredients. Thus, there is a reduced possibility that the bleach-sensitive ingredients and the percarbonate or perborate are in contact and react together.

In particular in compositions whereby bleach-sensitive ingredients are present as admixed granules, or even more in compositions whereby the bleach-sensitive ingredients are sprayed onto the detergent particles, including the percarbonate, it has been found beneficial for the stability of the bleach-sensitive ingredients, that the hydrogen peroxide source has the larger particle size of the invention.

It is known that in general the larger the particle size of a particle, the slower the particle dissolves in water. Thus, this would also be expected for particulate hydrogen peroxide sources dissolve slower in water. However, the inventors have surprisingly found that the larger particle size hydrogen peroxide sources of the invention, in particular percarbonate salts, have a water-solubility which is comparable to the water-solubility of smaller sources, such as for example percarbonate salts having an average particle size of around 600 or even 500 microns.

Also, the inventors have surprisingly found that the bleaching performance of detergent compositions incorporating a hydrogen peroxide source and a bleach activator is not always satisfactory after storage, even when the bleach is stable. Also they have found that the bleaching performance may differ from one batch of product to another.

They have now found that this can be due to the segregation of the hydrogen peroxide source component in, particularly, the granular product, during manufacturing or during storage, resulting in an uneven distribution of the hydrogen peroxide source component and/or bleach activator component.

The inventors have found that it can be advantageous that the a bleach activator component, or part thereof, also has an large average particle size, preferably similar to the particle size of the hydrogen peroxide source component, to reduce the segregation of theses components in the product. Preferably, the base granules of the composition also have an average particle size similar to the particle size of the hydrogen peroxide source component and preferably the bleach activator component.

SUMMARY OF THE INVENTION

The invention provides a solid composition comprising a bleach-sensitive component and a hydrogen peroxide source wherein the hydrogen peroxide source is present in a particulate component having an average particle size, by weight, of from 700 microns to 1100 microns, preferably from 700 microns to 1000 microns, whereby at least 80% by weight of the particulate component comprising the hydrogen peroxide source has a particle size of between 60% to 140% of the of the average particle size.

Preferably, the composition comprises one or more bleach activators.

DETAILED DESCRIPTION OF THE INVENTION

Hydrogen Peroxide Source

The hydrogen peroxide source herein is present in a particulate component of the composition, preferably being admixed to the other detergent components, preferably in the form of a separate granular component of the composition. The particulate component containing the hydrogen peroxide source preferably has an average particle size of from 700 microns to 1000 microns, more preferably from 750 or even 800 microns to 950 microns or even from 820 to 920 microns.

Hereby at least 80%, preferably at least 90% or even at least 95% or even substantially 100% by weight of the particulate component comprising the hydrogen peroxide source has a particle size which is 60% to 140% of the of the weight average particle size, preferably between 70% and 130% of the weight average particle size, or even more preferably from 80% to 120% of the weight average particle size.

It may be preferred that at least 70% or even at least 80% and more preferably at least 90% or even at least 95% of the component comprising the hydroxy peroxide source has a particle size of from 600 or even 710 microns to about 1180 microns, preferably from 710 microns to 1000 microns.

Hereby it may be preferred that less than 10% by weight or even less than 6% or even less than 4% by weight has a particle size of less than 425 microns or even 600 microns. Hereby it may also be preferred that less than 10% by weight or even less than 6% or even less than 4% by weight has a particle size of more than 1400 microns or even 1180 microns.

Preferably the weight distribution of the particle sizes of the component comprising the hydrogen peroxide source is very narrowly distributed around one mean or average or median.

For example preferred may be that the weight average particle size is 800 microns, whereby (by weight) 5% or less has a particle size of less than 600 microns and less than 2% has a particle size of more than 1180 microns. Also preferred may be that the weight average particle size is 800 microns whereby (by weight) 3% or less has a particle size of less than 425 microns and less than 5% has a particle size of more than 1400 microns The average particle size when used herein is a weight average particle size, obtained by analysing the particle size of a sample of the product by any conventional way, known in the art, for example by sieving the material through a series of sieves of given mesh sizes and measuring the weight fractions of the material which remain on the sieve and/or pass through the sieve. Minimum and maximum particle sizes are also measurable by sieving the material with sieves of a given mesh size, by ways known in the art.

Preferred hydrogen peroxide sources are perhydrate bleaches, such as metal peroxymonopersulfate, more preferably metal perborates and most preferably metal percarbonates, particularly the potassium or more preferably the sodium salts thereof.

In particular the percarbonate salts are used herein may be coated. Suitable coating agent are known in the art, for example hydrophobing agents such as wax, inorganic salts such as magnesium salts, sulphate salts and carbonates salts and silicates or mixtures thereof.

It may be preferred that the hydrogen peroxide source, and preferably the component containing it, has a solubility in water of 10° C. such that 75% of the theoretical maximum available oxygen (AvO) of said component is delivered in less than 10 minutes, preferably less than 8 minutes or even less than 6 minutes. It may be preferred hereby that at least 50% of the maximum theoretical available oxygen is delivered in less than 5 minutes, preferably in less than 4 minutes.

The solubility can be measured by: adding 5.0 gram of the hydrogen peroxide source or the component comprising it, in a plastic beaker of a Tergotometer ERWEKA, model DT6R, containing 1 liter of de-ionised water at 10C containing 50 ml acetic acid, mixing the water-hydrogen peroxide source-mixture with paddles with a speed of 150 rpm, taking 15 ml samples at the required times, and measuring the available oxygen in the sample by titration, for example with thiosulphate 0.1N with an automatic Mettler DL 25 titrator.

Bleach-Sensitive Ingredients

When used herein, the bleach-sensitive ingredients can be any ingredients known in the art which can be incorporated in detergent compositions and which may react with the hydrogen peroxide source or hydrogen peroxide during manufacturing of the composition, storage or in use, during the washing or cleaning operation with the composition.

For the purpose of the invention, the bleach-sensitive components or part thereof may in particular be present in the form of a spray-on component, which is sprayed onto the granules of the solid detergent composition of the invention. However, the bleach-sensitive components or part thereof may also be present in other forms, for example as admixed granules, or the bleach-sensitive component or part thereof may be comprised in the base granules.

Preferred bleach-sensitive components herein comprise perfumes, enzymes, brighteners, dyes, photo-bleaching agents, dispersants, soil release agent, in particular any of these ingredients comprising a functional group which can be oxidised, for example an alkenyl group, an aldehyde group or amine group. Suitable bleach-sensitive ingredients for use in the compositions of the present invention are described hereinafter.

The Detergent Composition

The detergent compositions of the invention are preferably solid laundry, dish washing or hard-surface cleaning compositions, most preferably laundry or dish washing compositions. The compositions are preferably in the form of granules, although also envisaged herein are tablets, bars and flakes, preferably made from particulate components.

The composition preferably comprises granules whereof at least 60%, more preferably at least 80% by weight have an average particle size, by weight, of from 600 microns to 1400 microns, preferably from 700 microns to 1100 microns or even 750 to 1000 microns. It may be preferred that the compositions comprises less than 20% or even less than 10% or even less than 5% by weight of particulate components of a particle size of less than 300 microns, or even less than 425 microns or even less than 600 microns; it may also be preferred the composition comprise less than 20% or even less than 10% or even less than 5% by weight of the composition, of particulate components of a particle size of more than 1700 microns, or even more than 1400 microns or even more than 1180 microns.

The composition can be made by any method known in the art, including by agglomeration and/or spray-drying, whereby certain ingredients may be admixed or sprayed-on as described herein. It may be preferred that the composition is made by mixing all or part of the granules, including those made by agglomeration or spray-drying, and subsequently adding a binder and mixing or agglomerating the granules and binder to form the, preferably agglomerated detergent granules. These may be of the required particle size or they may be sieved to obtain particles of the required size. Hereby, it may be preferred that the admixed hydrogen peroxide source-containing components is not mixed agglomerated together with the other granules and the binder.

The compositions are preferably solid detergents which preferably have a density of at least 350 g/liter, more preferably at least 500 g/liter or even at least 580 g/liter.

The compositions in accord with the invention may also contain additional detergent components. The precise nature of these additional components, and levels of incorporation thereof will depend on the physical form of the composition or component, and the precise nature of the washing operation for which it is to be used.

Highly preferred is that as additional ingredient one or more bleach activators are present, as described hereinafter.

In one embodiment of the invention, it may be preferred that the detergent composition herein comprise one or more anionic surfactants and an aluminosilicate builder, whereby it is preferred that only small amounts of the aluminosilicate builder and the anionic surfactant are in an intimate mixture, i.e. less than 50% or even less than 30% of the total amount of the anionic surfactant and less than 50% or even less than 30% of the total amount of alumnisilicate; it may even be preferred that substantially no anionic surfactant and aluminosilicate builder are in an intimate mixture. Thus, it may be preferred that the composition comprises at least two separate particles which comprise either anionic surfactant or aluminosilicate. 'Intimate mixture' means for the purpose of the invention that the two or more ingredients the component are substantially homogeneously divided in the component or particle. Namely, it has been found that the solubility and/or dispensing of the composition is thereby improved.

In another embodiment of the invention, it may be preferred that the composition only comprises low levels of aluminosilicate builder, for example less than 10% or even less than 5% by weight of the composition, whereby it is preferred that the composition comprises highly soluble builders, for example sodium citrate or citric acid, carbonate, and/or crystalline layered silicate.

It may also be preferred that the composition comprises as builder system or as part of the builder system, an agglomerate comprising from 0.5% to 80% by weight a crystalline layered silicate, preferably, NaSKS-6, and from 10% to 70% by weight of a surfactant, preferably an anionic surfactant, whereby it may be preferred that less than 10% by weight of the agglomerate of free moisture, more preferably 30% to 60% by weight a crystalline layered silicate and 20% to 50% by weight of an anionic surfactant.

Effervescence Component

It may be highly preferred that the detergent composition comprises an effervescence component, preferably comprising an acid source and an alkali source capable of reacting together to form a gas upon contact with water, in particular a carbon dioxide gas, formed by reaction of an organic carboxylic acid and a carbonate source. For the purpose of the invention, the ingredients of the effervescence components may be present in an intimate mixture with one another, preferably in the form of a granule or the may be present in separate particles.

It may be preferred that the effervescence component is a particulate component having an average particle size, by weight, of from 700 microns to 1400 microns, preferably from 750 microns to 1100 microns, preferably comprising an acid source and an alkali source.

It may be preferred that the effervescence component is substantially free of water, preferably such that no water has been intimately mixed with the effervescence component or part thereof or that no water is present other than the moisture of the raw materials themselves. Typically, the level of water in intimate mixture with the effervescence component is below 5% by weight of the total granule, preferably below 3% and more preferably below 1.5%, preferably obtainable by dry-powder compaction or pressure agglomeration.

These preferred dry effervescent particles result in a very fast carbon dioxide production and therefore in accelerated dispersibility and dissolution rate of the granular composition. The granular compositions of the present invention, as described herein, comprising the dry effervescent granules allow dispensing and dissolution in water of the granular compositions in a shorter period of time and at lower total level of effervescent particles/materials and ensure a faster and more effective delivery of detergent ingredients to the wash.

Suitable acids to be used herein include solid organic, mineral or inorganic acids, salts or derivatives thereof or a mixture thereof. It may be preferred that the acids are mono-, bi- or tri-protonic acids. Such acids include mono- or polycarboxylic acids preferably citric acid, adipic acid, glutaric acid, 3 chetoglutaric acid, citramalic acid, tartaric acid, maleic acid, fumaric acid, malic acid, succinic acid, malonic acid. Such acids are preferably used in their acidic forms, and it may be preferred that their anhydrous forms are used, or mixtures thereof. Derivatives also include ester of the acids.

The effervescence component or source preferably comprises a carbonate source, including carbonate, bicarbonate and percarbonate salts, in particular bicarbonate and/or carbonate. Suitable carbonates to be used herein include carbonate and hydrogen carbonate of potassium, lithium, sodium, and the like amongst which sodium and potassium carbonate are preferred. Suitable bicarbonates to be used herein include any alkali metal salt of bicarbonate like lithium, sodium, potassium and the like, amongst which sodium and potassium bicarbonate are preferred. Bicarbonate may be preferred to carbonate, because it is more-weigh effective, i.e., at parity weigh bicarbonate is a larger $CO_2$ "reservoir" than carbonate. However, the choice of carbonate or bicarbonate or mixtures thereof in the dry effervescent granules may be made depending on the pH desired in the aqueous medium wherein the dry effervescent granules are dissolved. For example where a relative high pH is desired in the aqueous medium (e.g., above pH 9.5) it may be preferred to use carbonate alone or to use a combination of carbonate and bicarbonate wherein the level of carbonate is higher than the level of bicarbonate, typically in a weight ratio of carbonate to bicarbonate from 0.1 to 10, more preferably from 1 to 5 and most preferably from 1 to 2.

Such an effervescence granule may also comprise a binder, including surfactants, such as anionic and nonionic surfactants.

The effervescence component is preferably present in the composition according to the present invention at a level of from 0.5% to 60% by weight, preferably from 2% to 50%, more preferably from 5% to 45% and preferably such that the acid component is present at a level of from 0.3% to 40%, more preferably from 1.0% to 35%, or even 2% to 25% or even to 15% by weight of the composition.

Bleach Activator

The composition preferably comprises a bleach activator, preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in situ reaction of the precursor with a source of hydrogen peroxide.

The bleach activator may alternatively, or in addition comprise a preformed peroxy acid bleach.

It is preferred that the bleach activator is present in a particulate component in the compositions herein. It may be preferred that the is present as a separate, admixed particle. Alternatively, the bleach activator or part thereof can be present in the base detergent particle.

Preferably, at least one of the bleach activators, preferably a peroxy acid bleach precursor, is present in a particulate component having an average e particle size, by weight, of from 600 microns to 1400 microns, preferably from 700 microns to 1100 microns. More preferably, all of the activator are present in one or more particulate components having the specified weight average particle size.

Hereby, it may be preferred that at least 80%, preferably at least 90% or even at least 95% or even substantially 100% of the component or components comprising the bleach activator have a particle size of from 300 microns to 1700 microns, preferably from 425 microns to 1400 microns.

The hydrophobic peroxy acid bleach precursor preferably comprises a compound having a oxy-benzene sulphonate group, preferably NOBS, DOBS, LOBS and/or NACA-OBS, as described herein.

The hydrophilic peroxy acid bleach precursor preferably comprises TAED, as described herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

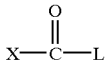

where L is a leaving group and X is essentially any functionality such tha to perhydroloysis the structure of the peroxyacid produced is

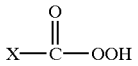

For the purpose of the invention, hydrophobic peroxyacid bleach precursors produce a peroxy acid of the formula above wherein X is a group comprising at least 6 carbon atoms and a hydrophilic peroxyacid bleach precursor produces a peroxyacid bleach of the formula above wherein X is a group comprising 1 to 5 carbon atoms.

Peroxyacid bleach precursor compounds are preferably incorporated at a level of from 0.5% to 20% by weight, more preferably from 1% to 15% by weight, most preferably from 1.5% to 10% by weight of the detergent compositions. The ratio of hydrophilic to hydrophobic bleach precursors, when present, is preferably from 10:1 to 1:10, more preferably from 5;1 to 1:5 or even from 3:1 to 1:3.

Suitable peroxyacid bleach precursor compounds typically contain one or more N- or O-acyl groups, which precursors can be selected from a wide range of classes. Suitable classes include anhydrides, esters, imides, lactams and acylated derivatives of in imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L group are selected from the group consisting of:

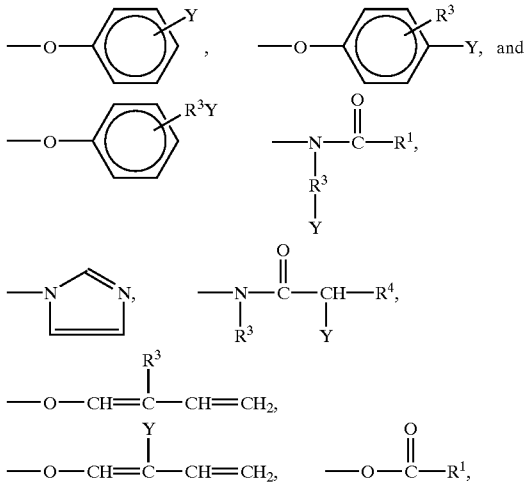

-continued

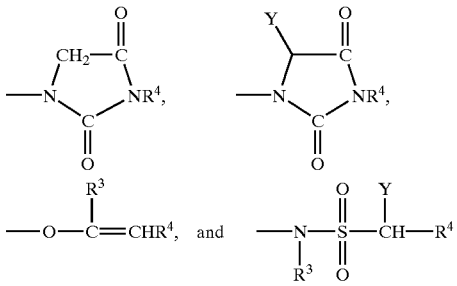

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammmonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator arid X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred as hydrophilic peroxy acid bleach precursor.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are suitable herein, including those of the following general formulae:

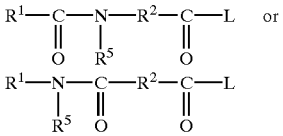

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386. It can be preferred that $R^1$ and $R^5$ forms together with the nitrogen and carbon atom a ring structure.

Preferred examples of bleach precursors of this type include amide substituted peroxyacid precursor compounds selected from (6-octanamido-caproyl)oxybenzenesulfonate, (6-decanamido-caproyl)oxybenzene-sulfonate, and the highly preferred (6-nonanamidocaproyl)oxybenzene sulfonate, and mixtures thereof as described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl amonium group, preferably an ethyl or methyl ammonium group. Cationic peroxyacid precursors are typically present in the solid detergent compositions as a salt with a suitable anion, such as a halide ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Examples of preferred cationic peroxyacid precursors are described in UK Patent Application No. 9407944.9 and U.S. patent application Ser. Nos. 08/298903, 08/298650, 08/298904 and 08/298906.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides. Preferred cationic peroxyacid precursors of the N-acylated caprolactam class include the trialkyl ammonium methylene benzoyl caprolactams and the trialkyl ammonium methylene alkyl caprolactams.

Benzoxazin Organic Peroxyacid Precursors

Also suitable are precursor compounds of the benzoxazin-type, as disclosed for example in EP-A-332,294 and EP-A-482,807, particularly those having the formula:

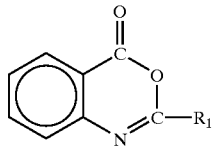

wherein $R_1$ is H, alkyl, alkaryl, aryl, or arylalkyl.

Preformed Organic Peroxyacid

The detergent composition may contain, in addition to, or as an alternative to, an organic peroxyacid bleach precursor compound, a preformed organic peroxyacid , typically at a level of from 1% to 15% by weight, more preferably from 1% to 10% by weight of the composition.

A preferred class of organic peroxyacid compounds are the amide substituted compounds of the following general formulae:

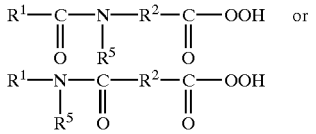

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Dye

A preferred ingredients of the compositions of the invention are dyes and dyed particles or speckles, which can be bleach-sensitive. The dye as used herein can be a dye stuff or an aqueous or nonaqueous solution of a dye stuff. It may be preferred that the dye is an aqueous solution comprising a dyestuff, at any level to obtain suitable dyeing of the detergent particles or speckles, preferably such that levels of dye solution are obtained up to 2% by weight of the dyed particle, or more preferably up to 0.5% by weight, as described above. The dye may also be mixed with a non-aqueous carrier material, such as non-aquous liquid materials including nonionic surfactants.

Optionally, the dye also comprising other ingredients such as organic binder materials, which may also be a non-aqueous liquid.

The dyestuff can be any suitable dyestuff. Specific examples of suitable dyestuffs include E104—food yellow 13 (quinoline yellow), E110—food yellow 3 (sunset yellow FCF), E113—food blue 5 (patent blue V); Ultra Marine blue (trade name), E133—food blue 2 (brilliant blue FCF), E140—natural green 3 (chlorophyll and chlorophyllins), E141 and Pigment green 7 (chlorinated Cu phthalocyanine). Preferred dyestuffs may be Monastral Blue BV paste (trade name) and/or Pigmasol Green (trade name).

The dyed detergent particles preferably comprise such a up to 10% or more preferably up to 2% or even up to 1% by weight of the dyed particle.

Perfumes

Another preferred ingredient of the compositions of the invention is a perfume or perfume composition. Any perfume composition can be used herein. The perfumes may also be encapsulated.

Preferred perfumes containing at least one component with a low molecular weight volatile component, e.g. having a molecular weight of from 150 to 450 or preferably 350.

Preferably, the perfume component comprises an oxygen-containing functional group. Preferred functional groups are aldehyde, ketone, alcohol or ether functional groups or mixtures thereof.

Suitable aliphatic ketones are e.g.:

2,7,8,-trimethyl-1-acetyl-cyclododeca-2,5,7-triene 7-acetyl-1,1,6,7,-tetramethyl-1,2,3,4,5,6,7,8,-octahydronaphthalene isolongifolanone gamma-irone alpha-vetivone Suitable aromatic ketones are e.g.:

4-(p-hydroxyphenyl)-butan-2-one 1,1,2,4,4,7-hexamethyl-6-acetyl-tetralin benzophenone methyl naphthyl ketone Suitable aliphatic aldehydes are e.g.:

2-methylhendecanal undecanal 4 (4'-methyl-4'-hydroxypentyl)-cyclohex-3-ene carbaldehyde 7-(formyl-5-isopropyl-2-methyl-bicyclo[2.2.2]oct-2-ene 4-(tricyclo[5.2.1.0{2,6}]decylidene-8)-butanal 4-(4'-metylpent-3-enyl)-cyclohex-3-ene carbaldehyde Suitable aromatic aldehydes are e.g.:

alpha-hexylcinnamic aldehyde.

anisic aldehyde helliotropin 2-phenylpropanal dihydrocinnamic aldehyde 3-(p-tert.butylphenyl)-2-methylpropanal Suitable condensaton products of aldehydes and amines are e.g.

methyl N-(2,4-dimethyl-3-cyclohexenyl)methylidene-anthranilate methyl N-(3,7-dimethyl-7-hydroxy-octylidene)-anthranilate methyl N-(4-(4'-methyl-4'-hydroxypentyl)cyclohex-3-enyl]methylideneanthranilate Suitable macrocyclic lactone musks are e.g.:

ethylene dodecanedioate 11-oxahexadecanolide cyclopentadecanolide

Preferred perfumes herein can be modified starch encapsulated High Impact Accord ("HIA") perfume oil particles. Preferred HIA perfume oils include 4-(2,2,6-Trimethylcyclohex-1-enyl)-2-en-4-one 2,4-Decadienoic acid, ethyl ester (E,Z)-

6-(and -8) isopropylquinoline

Acetaldehyde phenylethyl propyl acetal

Acetic acid, (2-methylbutoxy)-, 2-propenyl ester

Acetic acid, (3-methylbutoxy)-, 2-propenyl ester 2,6,10-Trimethyl-9-undecenal

Glycolic acid, 2-pentyloxy-, allyl ester

Hexanoic acid, 2-propenyl ester

1-Octen-3-ol trans-Anethole iso buthyl (z)-2-methyl-2-butenoate

Anisaldehyde diethyl acetal

Benzenepropanal, 4-(1,1-dimethylethyl)-2,6-Nonadien-1-ol 3-methyl-5-propyl-cyclohexen-1-one Butanoic acid, 2-methyl-, 3-hexenyl ester, (Z)-Acetaldehyde,

[(3,7-dimethyl-6-octenyl)oxy]

Lauronitrile 2,4-dimethyl-3-cyclohexene-1-carbaldehyde

2-Buten-1-one, 1-(2,6,6-trimethyl-1,3-cyclohexadien-1-yl)-

2-Buten-1-one, 1-(2,6,6trimethyl-2-cyclohexen-1-yl)-(E)- gamma-Decalactone trans-4-decenal decanal

2-Pentylcyclopentanone 1-(2,6,6 Trimethyl 3 Cyclohexen-1-yl)-2 Buten-1-one)

2,6-dimethylheptan-2-ol

Benzene, 1,1'-oxybis-

4-Penten-1-one, 1-(5,5-dimethyl-1-cyclohexen-1-yl)-

Butanoic acid, 2-methyl-, ethyl ester

Ethyl anthranilate

2-Oxabicyclo[2.2.2]octane, 1,3,3-trimethyl-

Eugenol 3-(3-isopropylphenyl)butanal methyl 2-octynoate 4-(2,6,6-trimethyl-1-cyclohexen-1-yl-3-buten-2-one Pyrazine, 2-methoxy-3-(2-methylpropyl)-

Quiniline, 6-secondary buty

Isoeugenol

2H-Pyran-2-one, tetrahydro-6-(3-pentenyl)-

Cis-3-Hexenyl Methyl Carbonate

Linalool 1,6,10-Dodecatriene, 7,11-dimethyl-3-methylene-,(E)-

2,6-dimethyl-5-heptenal 4,7 Methanoindan 1-carboxaldehyde, hexahydro 2-methylundecanal methyl 2-nonynonate 1,1-dimethoxy-2,2,5-trimethyl-4-hexene Benzoic acid, 2-hydroxy-, methyl ester 4-Penten-1-one, 1-(5,5-dimethyl-1-cyclohexen-1-yl)

2H-Pyran, 3,6-dihydro-4-methyl-2-(2-methyl-1-propenyl)-

2,6-Octadienenitrile, 3,7-dimethyl-, (Z)-

2,6-nonadienal

6-Nonenal, (Z)- nonanal octanal

2-Nonenenitrile

Acetic acid, 4-methhylphenyl ester

Gamma Undecalactone 2-norpinene-2-propionaldehyde 6,6 dimethyl 4-nonanolide 9-decen-1-ol 2H-Pyran, tetrahydro-4-methhyl-2-(2-methhyl-1-propenyl)-

5-methyl-3-heptanone oxime

Octanal, 3,7-dimethyl- 4-methyl-3-decen-5-ol

10-Undecen-1-al

Pyridine, 2-(1-ethylpropyl)-

Spiro[furan-2(3H),5'-[4,7]methano[5H]indene], decahydro-

Additionally, the perfume can also contain a perfume precursor.

Perfume precursors are capable of forming a perfume component, with the characteristics described above, once exposed to wash conditions. Preferably, the perfume precursor forms a perfume component by hydrolysis under aqueous conditions.

Preferred perfume precursors herein are nonionic or anionic esters of an allylic alcohol perfume having the formula:

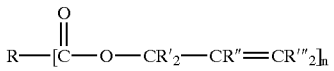

wherein n is an integer of 1 or greater; and R is selected from the group consisting of $C_1$–$C_{30}$, preferably $C_1$–$C_{20}$, straight, branched or cyclic alkyl, alkenyl, alkynyl, alkylaryl, or aryl group, and represents the group attached to the carboxylate function of the carboxylic acid used to make the perfume ester. Each R', R", and each R'" selected from the group consisting of hydrogen, or a $C_1$–$C_{20}$ straight, branched or cyclic alkyl, alkenyl, alkynyl, alkylaryl, or aryl group. R, R', R" and R'" are selected in such a manner that the molecular weight of the allylic alcohol is from 150 to 350.

In the most preferred embodiment, R' and R" are hydrogen, one R'" is hydrogen, methyl, or ethyl, and the other R'" is a straight, branched or cyclic $C_1$–$C_{10}$ alkyl or alkenyl group. Also cis/trans (also referred to as Z/E) isomers at the double bond in the structure shown above and stereoisomers of the above structure are possible.

Preferred perfume components may be selected from the group comprising the esters of geraniol and/or nerol. Geraniol and nerol are trans/cis structural isomers (at the 2,3 position double bond) of the molecules having the formula $HO—CH_2—CH{=}C(CH_3)—CH_2—CH_2—CH{=}C(CH_3)_2$.

Heavy Metal Ion Sequestrant

The compositions of the invention preferably contain as an optional component a heavy metal ion sequestrant or chelant or chelating agent. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-3,99,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine N,N'-diacetic acid, aspartic acid-N,N'-diacetic acid, aspartic acid-N-monoacetic acid and imino-disuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide N,N'-disuccinic acid (GADS), ethylenediamine N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine N,N'-disuccinic acid (EDDS) and 1,1-hydroxyethane diphosphonic acid or the alkali metal, alkaline earth metal, ammonium, or substituted ammonium salts thereof, or mixtures thereof.

In particular the chelating agents comprising a amino or amine group can be bleach-sensitive and are suitable in the compositions of the invention.

Enzyme

Another highly preferred ingredient useful in the compositions herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformnis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/U.S. 9703635, and in WO95/26397 and WO96/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge Jensen et al, issued Mar. 7, 1989.

Optical Brightener

The compositions herein also preferably contain from about 0.005% to 5% by weight of certain types of hydrophilic optical brighteners, as mentioned above.

Hydrophilic optical brighteners useful herein include those having the structural formula:

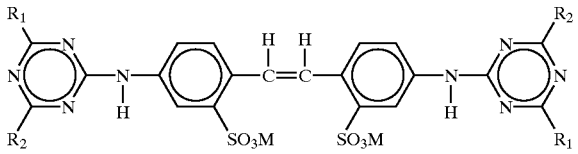

wherein $R^1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

Photo-Bleaching Agent

Photo-bleaching agents are preferred ingredients of the oppositions herein. Preferred photo-bleaching agent herein comprise a compounds having a porphin or porphyrin structure.

Porphin and porphyrin, in the literature, are used as synonymys, but conventionally porphin stands for the simplest porphyrin without any substituents; wherein porphyrin is a sub-class of porphin. The references to porphin in this application will include porphyrin.

The porphin structures preferably comprise a metal element or cation, preferably Ca, Mg P, Ti, Cr, Zr, In, Sn or Hf, more preferably Ge, Si or Ga, or more preferably. Al, most preferably Zn.

It can be preferred that the photo-bleaching compound or component is substituted with substituents selected from alkyl groups such as methyl, ethyl, propyl, t-butyl group and aromatic ring systems such as pyridyl, pyridyl-N-oxide, phenyl, naphthyl and anthracyl moieties.

The photo-bleaching compound or component can have solubilizing groups as substituents. Alternatively, or in addition hereto the photo-bleaching agent can comprise polymeric component capable of solubilizing the photo-bleaching compound, for example PVP, PVNP, PVI or co-polymers thereof or mixtures thereof.

Highly preferred photo-bleaching compounds are compounds having a phthalocyanine structure, which preferably have the metal elements or cations described above.

Metal phthalocyanines and their derivatives have the structure indicated in FIG. 1 and/or FIG. 2, wherein the atom positions of the phthalocyanine structure are numbered conventionally.

The phthalocyanines can be substituted for example the phthalocyanine structures which are substituted at one or more of the 1–4, 6, 8–11, 13, 15–18, 20, 22–25, 27 atom positions.

Surfactant

The compositions in accord with the invention preferably contain one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitterionic surfactants are generally used in combination with one or more anionic and/or nonionic surfactants.

Anionic Surfactant

The compositions in accord with the present invention preferably comprise an additional anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and —N-($C_1$–$C_2$ hydroxyalkyl) glucamine sulfates, and sulfates of alkylpolysacchardes such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_xCH_2COO^-M^+$ wherein R ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2 propyl-1-nonanoic acid, 2-butyl-1-octanoic acid and 2-penttyl-1-heptanoic acid.

Certain soaps may also be included as suds suppressors.

Alkali Metal Sarcosinate Surfactant

Other suitable anionic surfactants are the alkali metal sarcosinates of formula $R—CON(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$-hydrocarbyl, 2-hydroxy ethyl, 2-hydroxy propyl, ethoxy, propoxy, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl groups containing from 7 to 21, preferably from 9 to 17 carbon atoms and each $R^7$ is selected from the group consisting of hydrogen, $C_1$–$C_4$ alkyl $C_1$–$C_4$ hydroxyalkyl, and $—(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Cationic Surfactants

Suitable cationic surfactants to be used in the detergent herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen, and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example $CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic Mono-Alkoxylated Amine Surfactants

Highly preferred herein are cationic mono-alkoxylated amine surfactant preferably of the general formula I:

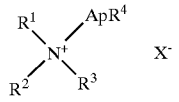

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —$CH_2CH_2OH$, —$CH_2CH_2CH_2OH$, —$CH_2CH(CH_3)OH$ and —$CH(CH_3)CH_2OH$, with —$CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

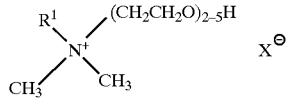

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0.1% to 20%, more preferably from 0.2% to 7%, most preferably from 0.3% to 3.0% by weight of the composition.

Cationic Bis-Alkoxylated Amine Surfactant

The cationic bis-alkoxylated amine surfactant preferably has the general formula II:

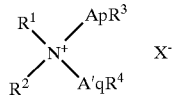

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R_4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof. p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

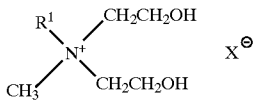

wherein $R^1$ is $C_{10}$–$C_{18}$ hydrocarbyl and mixtures thereof preferably $C_{10}$–$C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

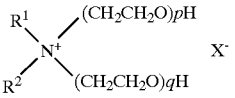

wherein $R^1$ is $C_{10}$–$C_{18}$ hydrocarbyl, preferably $C_{10}$–$C_{14}$ alkyl, independently p is 1 to about 3 and q is 1 to about 3, $R^2$is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Bleach Catalyst

The composition can contain a transition metal containing bleach catalyst.

One suitable type of bleach catalyst is a catalyst system comprising a transition metal cation of defined bleach catalytic activity, such as copper, iron or manganese cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese based complexes disclosed in U.S. Pat. No. 5,246,621 and U.S. Pat. No. 5,244,594. Others are described in European patent application publication no. 549,272. The bleach catalysts useful herein may also be selected as appropriate for the present invention. For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

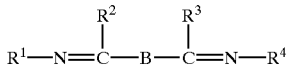

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging groups selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine cobalt (II), trisdipyridylamine cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include binuclear Mn complexed with tetra-N-dentate and bi-N-dentate ligands, including $N_4Mn^{III}$ (u—O)$_2Mn^{IV}N_4)^+$ and [$Bipy_2Mn^{III}$ (u—O)$_2Mn^{IV}bipy_2$]—$(ClO_4)_3$.

Other bleach catalysts are described, for example, in European patent application, publication no. 408,131 (cobalt complex catalysts), European patent applications, publication nos. 384,503, and 306,089 (metallo-porphyrin catalysts), U.S. Pat No. 4,728,455 (manganese/multidentate ligand catalyst), U.S. Pat. No. 4,711,748 and European patent, application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

The bleach catalyst is typically used in a catabolically effective amount in the compositions and processes herein. By "catabolically effective amount" is meant an amount which is sufficient, under whatever comparative test conditions are employed, to enhance bleaching and removal of the stain or stains of interest from the target substrate. The test conditions will vary, depending on the type of washing appliance used and the habits of the user. Some users elect to use very hot water; others use warn or even cold water in laundering operations. Of course, the catalytic performance of the bleach catalyst will be affected by such considerations, and the levels of bleach catalyst used in fully-formulated detergent and bleach compositions can be appropriately adjusted. As a practical matter, and not by way of limitation, the compositions and processes herein can be adjusted to provide on the order of at least one part per ten million of the active bleach catalyst species in the aqueous washing liquor, and will preferably provide from about 1 ppm to about 200 ppm of the catalyst species in the wash liquor. To illustrate this point further, on the order of 3 micromolar manganese catalyst is effective at 40° C., pH 10 under European conditions using perborate and a bleach precursor. An increase in concentration of 3–5 fold may be required under U.S. conditions to achieve the same results.

Water-Soluble Builder Compound

The compositions in accord with the present invention preferably contain a water-soluble builder compound, typically present in detergent compositions at a level of from 1% to 80% by weight, preferably from 10% to 60% by weight, most preferably from 15% to 40% by weight of the composition.

The detergent compositions of the invention preferably comprise phosphate containing builder material. Preferably present at a level of from 0.5% to 60%, more preferably from 5% to 50%, more preferably from 80% to 40.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboylate materials such as 2-oka-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycaboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing-borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The compositions in accord with the present invention may contain a partially soluble or insoluble builder compound, typically present in detergent compositions at a level of from 0.5% to 60% by weight, preferably from 5% to 50% by weight, most preferably from 8% to 40% weight of the composition.

Examples of largely water insoluble builders include the sodium aluminosilicates. As mentioned above, it may be preferred in one embodiment of the invention, that only small amounts of alumino silicate builder are present.

Suitable aluminosilicate zeolites have the unit cell formula $Na_z[(AlO_2)_z\ (SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but arc preferably synthetically derived. Synthetic crystalline aluminosilicate ion exchange materials are available under the designations Zeolite A, Zeolite B, Zeolitc P, Zeolitc X, Zeolite HS and mixtures thereof. Zeolite A has the formula:

$$Na_{12}[AlO_2)_{12}\ (SiO_2)_{12}].xH_2O$$

wherein x is from 20 to 30, especially 27. Zeolite X has the formula $Na_{86}[(AlO_2)_{86}\ (SiO_2)_{106}].\ 276\ H_2O$.

Another preferred aluminosilicate zeolite is zeolite MAP builder.

The zeolite MAP can be present at a level of from 1% to 80%, more preferably from 15% to 40% by weight of the compositions.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometers, more preferably from 2.0 to 7.0 micrometers, most preferably from 2.5 to 5.0 micrometers.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Organic Polymeric Compound

Organic polymeric compounds are preferred additional components of the compositions herein and are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein-are cotton and non-cotton soil release polymer according to U.S. Pat. No. 4,968,451, Scheibel et al., and U.S. Pat. No. 5,415,807, Gosselink et al., and in particular according to U.S. application Ser. No. 60/051517.

Another organic compound, which is a preferred clay dispersant/anti-redeposition agent, for use herein, can be the ethoxylated cationic monoamines and diamines of the formula:

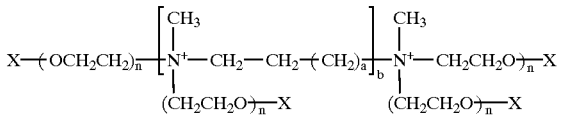

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No. 4,664,848.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
   (i) polydimethyl siloxane, at a level of from 50% to 99%, preferably 75% to 95% by weight of the silicone antifoam compound; and
   (ii) silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight.

(b) a dispersant compound, most preferably comprising a silicone glycol rake copolymer with a polyoxyalkylene content of 72–78% and ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Coming under the tradename DC0544;

(c) an inert carrier fluid compound, most preferably comprising a $C_{16}$–$C_{18}$ ethoxylated alcohol with a degree of ethoxylation of from 5 to 50, preferably 8 to 15 at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polcarboxylic polymers, such as copolymers of laic and acrylic acid.

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Polymeric Soil Release Agent

Polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene teiephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and. $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo K.K.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate based SRA's of the urethane linked variety, see U.S. Pat. No. 4,201,824, Violland et al.;

Other Optional Ingredients

Other optional ingredients suitable for inclusion in the compositions of the invention include colours and filer salts, with sodium sulfate being a preferred filer salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

Form of the Compositions

The composition of the invention can be made via a variety of methods, including dry-mixing, agglomerating, compaction, or spray-dying of the various compounds comprised in the detergent component, or mixtures of these techniques.

The compositions herein can take a variety of physical forms including liquid, but preferably solid forms such as tablet, flake, pastille and bar, and preferably granular forms.

The compositions in accord with the present invention can also be used in or in combination with bleach additive compositions, for example comprising chlorine bleach.

Chlorine-Based Bleach

The detergent compositions can include as an additional component a chlorine based bleach. However, since the detergent compositions of the invention are solid, most liquid chlorine based bleaching will not be suitable for these detergent compositions and only granular or powder achlorine-based bleaches will be suitable.

Alternatively, the detergent compositions can be formulated such that the are chlorine-based bleach-compatible, thus ensuring that a chlorine based bleach can be added to the detergent composition by the user at the beginning or during the washing process.

The chlorine-based bleachis such that a hypochlorite species is formed in aqueous solution. The hypochlorite ion is chemically represented by the formula $OCl^-$.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin, N-chlorosulfamide, Chloramine T, Dichloramine T, chloramine B and Dichloramine B. A preferred bleaching agent for use in the compositions of the instant invention is sodium hypochlorite, potassium hypochlorite, or a mixture thereof. A preferred chlorine based bleach can be Triclosan (trade name).

Most of the above described hypochlorite yielding bleaching agents are available in solid or concentrated form and are dissolved in water during preparation of the compositions of the instant invention. Some of the above materials are available as aqueous solutions.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liter, as are typical product dosages and wash solution volumes commonly employed in conventional machine laundry methods. Preferred washing machines may be the so-called low-fill machines.

In a preferred use aspect the composition is formulated such that it is suitable for hard-surface cleaning or hand washing. In another preferred aspect the detergent composition is a pre-treatment or soaking composition, to be used to pre treat or soak soiled and stained fabrics.

Abbreviations used in the Granular Detergent Composition Examples

In the detergent compositions, the abbreviated component identifications have the following meanings:

LAS: Sodium linear C11–13 alkyl benzene sulfonate.
TAS: Sodium tallow alkyl sulfate
CxyAS: Sodium C1x–C1y alkyl sulfate
C46SAS: Sodium C14–C16 secondary (2,3) alkyl sulfate
CxyEzS: Sodium C1x–C1y alkyl sulfate condensed with z moles of ethylene oxide
CxyEz: C1x–C1y predominantly linear primary alcohol condensed with an average of z moles of ethylene oxide
QAS: R2.N+(CH3)2 (C2H4OH) with R2=C12–C14
QAS 1: R2.N+(CH3)2 (C2H4OH) with R2=C8–C11
APA: C8–C10 amido propyl dimethyl amine
Soap: Sodium linear alkyl carboxylate derived from an 80/20 mixture of tallow and coconut fatty acids
STS: Sodium toluene sulphonate
CFAA: C12–C14 (coco) alkyl N-methyl glucamide
TFAA: C16–C18 alkyl N-methyl glucamide
TPKFA: C12–C14 topped whole cut fatty acids
STPP: Anhydrous sodium tripolyphosphate
TSPP: Tetrasodium pyrophosphate
Zeolite A: Hydrated sodium aluminosilicate of formula Na12 (AlO2SiO2)12.27H2O having a primary particle size in the range from 0.1 to 10 micrometers (weight expressed on an anhydrous basis)
NaSKS-6: Crystalline layered silicate of formula d-Na2Si2O5
Citric acid: Anhydrous citric acid
Borate: Sodium borate
Carbonate: Anydrous sodium carbonate with a particle size between 200 μm and 900 μm
Bicarbonate: Anhydrous sodium bicarbonate with a particle size distribution between 400 μm and 1200 μm
Silicate: Amorphous sodium silicate (SiO2:Na2O=2.0:1)
Sulfate: Anhydrous sodium sulfate
Mg sulfate: Anhydrous magnesium sulfate
Citrate: Tri-sodium citrate dihydrate of activity 86.4% with a particle size distribution between 425 μm and 850 μm
MA/AA: Copolymer of 1:4 maleic/acrylic acid, average molecular weight about 70,000
MA/AA (1): Copolymer of 4:6 maleic/acrylic acid, average molecular weight about 10,000
AA: Sodium polyacrylate polymer of average molecular weight 4,500
CMC: Sodium carboxymethyl cellulose
Cellulose ether: Methyl cellulose ether with a degree of polymerization of 650 available from Shin Etsu Chemicals
Protease: Proteolytic enzyme, having 3.3% by weight of active enzyme, sold by NOVO Industries A/S under the tradename Savinase
Protease I: Proteolytic enzyme, having 4% by weight of active enzyme, as described in WO 95/10591, sold by Genencor Int. Inc.
Alcalase: Proteolytic enzyme, having 5.3% by weight of active enzyme, sold by NOVO Industries A/S
Cellulose: Cellulytic enzyme, having 0.23% by weight of active enzyme, sold by NOVO Industries A/S under the tradename Carezyme
Amylase: Amylolytic enzyme, having 1.6% by weight of active enzyme, sold by NOVO Industries A/S under the tradename Termamyl 120T
Lipase: Lipolytic enzyme, having 2.0% by weight of active enzyme, sold by NOVO Industries A/S under the tradename Lipolase
Lipase (1): Lipolytic enzyme, having 2.0% by weight of active enzyme, sold by NOVO Industries A/S under the tradename Lipolase Ultra
Endolase: Endoglucanase enzyme, having 1.5% by weight of active enzyme, sold by NOVO Industries A/S PB4: Particle containing sodium perborate tetrahydrate of nominal formula NaBO2.3H2O, the particles having a weight average particle size of 950 microns, 85% particles having a particle size of from 850 microns to 950 microns PB1: Particle containing anhydrous sodium perborate bleach of nominal formula NaBO2.H 2O2, the particles having a weight average particle size of 800 microns, 85% particles having a particle size of from 750 microns to 950 microns Percarbonate: Particle containing sodium percarbonate of nominal formula 2Na2CO3.3H2O2, the particles having a weight average particle size of 850 microns, 5% or less having a particle size of less than 600 microns and 2% or less having a particle size of more than 1180 microns NOBS: Particle comprising nonanoyloxybenzene sulfonate in the form of the sodium salt, the particles having a weight average particle size of 750 microns to 900 microns NAC-OBS: Particle comprising (6-nonamidocaproyl) oxybenzene sulfonate, the particles having a weight average particle size of from 825 microns to 875 microns TAED I: Particle containing tetraacetylethylenediamine, the particles having a weight average particle size of from 700 microns to 1000 microns TAED II: Tetraacetylethylenediamine of a particle size from 150 microns to 600 microns DTPA: Diethylene triamine pentaacetic acid DTPMP: Diethylene triamine penta (methylene phosphonate), marketed by Monsanto under the Tradename Dequest 2060

Photoactivated: Sulfonated zinc phthlocyanine encapsulated in bleach (1) dextrin soluble polymer Photoactivated: Sulfonated alumino phthlocyanine encapsulated in bleach (2) dextrin soluble polymer Brightener 1: Disodium 4,4'-bis(2-sulphostyryl)biphenyl Brightener 2: Disodium 4,4'-bis(4-anilino-6-morpholino-1.3.5-triazin-2-yl)amino) stilbene-2:2'-disulfonate EDDS: Ethylenediamine N,N'-disuccinic acid, (S,S) isomer in the form of its sodium salt.

HEDP: 1,1-hydroxyethane diphosphonic acid

PEGx: Polyethylene glycol, with a molecular weight of x (typically 4,000)

PEO: Polyethylene oxide, with an average molecular weight of 50,000

TEPAE: Tetraethylenepentaamine ethoxylate

PVI: Polyvinyl imidosole, with an average molecular weight of 20,000

PVP: Polyvinylpyrolidone polymer, with an average molecular weight of 60,000

PVNO: Polyvinylpyridine N-oxide polymer, with an average molecular weight of 50,000

PVPVI: Copolymer of polyvinylpyrolidone and vinylimidazole, with an average molecular weight of 20,000

QEA: bis((C2H5O)(C2H4O)n)(CH3)—N+—C6H12—N+—(CH3) bis((C2H5O)—(C2H4O))n, wherein n=from 20 to 30

SRP 1: Anionically end capped poly esters

SRP 2: Diethoxylated poly(1,2 propylene terephtalate) short block polymer

PEI: Polyethyleneimine with an average molecular weight of 1800 and an average ethoxylation degree of 7 ethyleneoxy residues per nitrogen Silicone antifoam: Polydimethylsiloxane foam controller with siloxane oxyalkylene copolymer as dispersing agent with a ratio of said foam controller to said dispersing agent of 10:1 to 100:1

Opacifier: Water based monostyrene latex mixture, sold by BASF Aktiengeselschaft under the tradename Lytron 621

Wax: Paraffin wax

In the following examples al levels are quoted as % by weight of the composition:

TABLE I

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |
| MBAS | — | — | | 5.0 | 5.0 | | — | — | — |
| $C_{45}AS$ | — | — | 1.0 | | 2.0 | 2.0 | — | — | — |
| $C_{45}AE_3S$ | — | — | | 1.0 | | | — | — | — |
| QAS | | | 1.0 | 1.0 | | | — | — | |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | | | — | — | — | — | 2.0 | 2.0 | — |
| MBAS | | | — | — | — | — | — | — | 1.0 |
| $C_{45}AS$ | | | — | — | — | — | 2.0 | — | — |
| $AE_3$ | | | — | — | — | — | — | 1.0 | 0.5 |
| Carbonate | | | — | — | 4.0 | 1.0 | 1.0 | 1.0 | — |

TABLE I-continued

The following compositions are in accordance with the invention.

| | A | B | C | D | E | F | G | H | I |
|---|---|---|---|---|---|---|---|---|---|
| Sodium citrate | | | — | — | — | — | — | — | 5.0 |
| CFAA | | | | | — | — | — | — | — |
| Citric acid | | | — | — | — | 4.0 | — | 1.0 | 1.0 |
| QEA | | | — | — | — | 2.0 | 2.0 | 1.0 | — |
| SRP | | | — | — | — | 1.0 | 1.0 | 0.2 | — |
| Zeolite A | | | — | — | — | 15.0 | 26.0 | 15.0 | 16.0 |
| Sodium silicate | | | — | — | — | — | — | — | — |
| PEG | — | — | — | — | — | — | 4.0 | — | — |
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/carbonate/bicarbonate (40:20:40) | 8.0 | 10.0 | 10.0 | 4.0 | — | 8.0 | 2.0 | 2.0 | 4.0 |
| QEA | — | — | — | 0.2 | 0.5 | — | — | — | — |
| NACAOBS | 3.0 | — | — | 4.5 | — | — | — | 2.5 | — |
| NOBS | 1.0 | 3.0 | 3.0 | — | — | — | — | — | 5.0 |
| TAED I | 2.5 | — | — | 1.5 | 2.5 | 6.5 | — | 1.5 | — |
| MBAS | — | — | — | 8.0 | — | — | 8.0 | — | 4.0 |
| LAS (flake) | 10.0 | 10.0 | — | — | — | — | — | 8.0 | — |
| Spray-on | | | | | | | | | |
| Brightener | 0.2 | 0.2 | 0.3 | 0.1 | 0.2 | 0.1 | — | 0.6 | 0.3 |
| Dye | — | — | — | 0.3 | 0.05 | 0.1 | — | — | — |
| AE7 | — | — | — | — | — | 0.5 | — | 0.7 | — |
| Perfume | 1.0 | 0.5 | 1.1 | 0.8 | 0.3 | 0.5 | 0.3 | 0.5 | — |
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | 24.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | — | 0.5 | 0.5 | — | 0.3 | — | 0.2 | — | — |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |
| Dyed carbonate (blue, green) | 0.5 | 0.5 | 1.0 | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE II

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |
| MBAS | — | — | — | 5.0 | 5.0 | | — | — | — |
| $C_{45}AS$ | — | — | 1.0 | | 2.0 | 2.0 | — | — | — |
| $C_{45}AE_3S$ | — | — | — | 1.0 | | | — | — | — |
| QAS | — | — | 1.0 | 1.0 | | | — | — | |
| DTPA, HEDP and/or EDDS | 0.3 | 0.3 | 0.3 | 0.3 | | | — | — | — |
| MgSO4 | 0.5 | 0.4 | 0.1 | — | | | — | — | — |
| Sodium citrate | 10.0 | 12.0 | 17.0 | 3.0 | 5.0 | | — | — | — |
| Sodium carbonate | 15.0 | 8.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | — | — | — | 2.0 | — | — | — | — | — |

TABLE II-continued

| The following compositions are in accordance with the invention. | | | | | | | | | |
|---|---|---|---|---|---|---|---|---|---|
| | A | B | C | D | E | F | G | H | I |
| SKS-6 | — | — | — | 3.0 | 5.0 | — | — | — | — |
| MA/AA or AA | 1.0 | 2.0 | 10.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | — | — | — | — | — | — | 2.0 | 2.0 | — |
| MBAS | — | — | — | — | — | — | — | — | 1.0 |
| $C_{45}AS$ | — | — | — | — | — | — | 2.0 | — | — |
| $AE_3$ | — | — | — | — | — | — | — | 1.0 | 0.5 |
| Carbonate | — | — | — | — | 4.0 | 1.0 | 1.0 | 1.0 | — |
| Sodium citrate | — | — | — | — | — | — | — | — | 5.0 |
| CFAA | — | — | — | | — | — | — | — | — |
| Citric acid | — | — | — | — | — | 4.0 | — | 1.0 | 1.0 |
| QEA | — | — | — | — | — | 2.0 | 2.0 | 1.0 | — |
| SRP | — | — | — | — | — | 1.0 | 1.0 | 0.2 | — |
| Zeolite A | — | — | — | — | — | 15.0 | 26.0 | 15.0 | 16.0 |
| Sodium silicate | — | — | — | — | — | — | — | — | — |
| PEG | — | — | — | — | — | — | 4.0 | — | — |
| TAED II | | | | | | | 3.0 | | 1.5 |
| Builder Agglomerates | | | | | | | | | |
| SKS-6 | 6.0 | 5.0 | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/carbonate/bicarbonate (40:20:40) | 8.0 | 10.0 | 4.0 | 4.0 | — | 8.0 | 2.0 | 2.0 | 4.0 |
| QEA | — | — | — | 0.2 | 0.5 | — | — | — | — |
| NACAOBS | 3.0 | — | — | 1.5 | — | — | — | 5.5 | — |
| NOBS/LOBS/DOBS | — | 3.0 | 3.0 | — | — | — | — | — | 5.0 |
| TAED I | 2.5 | — | — | 1.5 | 2.5 | 6.5 | — | 1.5 | — |
| MBAS | — | — | — | 8.0 | — | — | 8.0 | — | 4.0 |
| LAS (flake) | — | — | — | — | — | — | — | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | 0.8 | 0.5 | 1.0 |
| Dry-add | | | | | | | | | |
| Citrate | 4.0 | — | 3.0 | 4.0 | — | 5.0 | 15.0 | — | 5.0 |
| Percarbonate | 15.0 | 3.0 | 6.0 | 10.0 | — | — | 12.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.5 | 0.3 | 0.5 | 0.5 | 0.8 | 2.0 | 0.5 | 0.16 | 0.2 |
| Carbonate | — | — | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |
| Dyed carbonate (blue, green) | 0.5 | 0.5 | ? | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE III

The following are high density and bleach-containing detergent formulations according to the present invention:

| | A | B | C |
|---|---|---|---|
| Blown Powder | | | |
| Zeolite A | — | — | 15.0 |
| Sodium sulfate | 0.0 | 5.0 | 0.0 |
| LAS | 3.0 | — | 3.0 |
| C45AS | 3.0 | 2.0 | 4.0 |
| QAS | — | — | 1.5 |
| DTPMP | 0.4 | 0.4 | 0.4 |
| CMC | 0.4 | 0.4 | 0.4 |
| MA/AA | 4.0 | 2.0 | 2.0 |
| TAED II | — | — | 3.0 |
| Agglomerates | | | |
| QAS | 1.0 | — | — |
| LAS | — | 11.0 | 7.0 |
| TAS | 2.0 | 2.0 | 1.0 |
| Silicate | 3.0 | — | 4.0 |
| Zeolite A | 8.0 | 8.0 | 8.0 |
| Carbonate | 8.0 | 8.0 | 4.0 |
| Agglomerate | | | |
| NaSKS-6 (I) or (II) | 15.0 | 12.0 | 5.0 |
| LAS | 8.0 | 7.0 | 4.0 |
| AS | 5.0 | — | — |
| Spray On | | | |
| Perfume | 0.3 | 0.3 | 0.3 |
| C25E3 | 2.0 | — | 2.0 |
| brightener | 0.1 | 0.4 | |
| photobleach | 0.03 | 0.05 | — |
| Dry additives | | | |
| QEA | 1.0 | 0.5 | 0.5 |
| Citric/Citrate | 5.0 | — | 2.0 |
| Bicarbonate | — | 3.0 | — |
| Carbonate | 8.0 | 15.0 | 10.0 |
| NAC OBS | 6.0 | — | 5.0 |
| Manganese catalyst | — | — | 0.3 |
| TAED I | | 3.0 | — |
| NOBS | — | 2.0 | — |
| Percarbonate | 14.0 | 7.0 | 10.0 |
| Polyethylene oxide of MW 5,000,000 | — | — | 0.2 |
| Bentonite clay | — | — | 10.0 |
| Citric acid | — | — | 0.5 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Dry additives | | | |
| Sodium sulfate | 0.0 | 3.0 | 0.0 |
| Balance (Moisture and Miscellaneous) | 100.0 | 100.0 | 100.0 |
| Density (g/liter) | 850 | 850 | 850 |

What is claimed is:

1. A solid detergent composition comprising a bleach-sensitive component and a hydrogen peroxide source, wherein the hydrogen peroxide source is present in a particulate component having an average particle size, by weight, of from 700 microns to 1100 microns, whereby at least 80% by weight of the particulate component comprising the hydrogen peroxide source has a particle size which is 60% to 140% of the weight average particle size.

2. A solid component according to claim 1 whereby the hydrogen peroxide source comprises a percarbonate salt.

3. A solid detergent composition according to claim 2 whereby the percarbonate salt is such that 75% of the theoretical maximum available oxygen (AvO) of the percarbonate salt is delivered in less than 10 minutes.

4. A solid detergent composition according to claim 1 wherein the average particle size of the hydrogen peroxide source is from 800 microns to 950 microns.

5. A solid composition according to claim 1 comprising one or more bleach activators, whereby at least one of the bleach activators is present in a particulate component having an average particle size, by weight, of from 600 microns to 1400 microns.

6. A solid detergent composition according to claim 5, comprising a hydrophobic organic peroxyacid bleach precursor and a hydrophilic organic peroxy acid bleach precursor, the hydrophilic organic peroxyacid bleach precursor comprising TAED and the hydrophobic precursor comprising an oxy benzene sulphonate group.

7. A solid detergent composition according to claim 1 which is a granular composition wherein at least 80% of the granules of the composition have an average particle size, by weight, of from 700 microns to 1400 microns.

8. A detergent composition according to claim 1 wherein the bleach-sensitive component is selected from the group consisting of perfumes, soil release polymers, dispersants, chelants, dyes, photo-bleaching agents, brighteners and mixtures thereof.

9. A detergent composition according to claim 1 comprising a bleach sensitive spray-on component.

10. A detergent composition according to claim 1 comprising an effervescence component, being a particulate effervescence component having an average particle size, by weight, of from 700 microns to 1400 microns.

* * * * *